US011427970B2

(12) United States Patent
Loy

(10) Patent No.: US 11,427,970 B2
(45) Date of Patent: Aug. 30, 2022

(54) SWITCH

(71) Applicant: Getzner Werkstoffe Holding GmbH, Burs (AT)

(72) Inventor: Harald Loy, Schruns (AT)

(73) Assignee: Getzner Werkstoffe Holding GmbH, Bürs (AT)

( * ) Notice: Subject to any disclaimer, the term of this patent is extended or adjusted under 35 U.S.C. 154(b) by 204 days.

(21) Appl. No.: 16/641,398

(22) PCT Filed: Sep. 6, 2018

(86) PCT No.: PCT/AT2018/000069

§ 371 (c)(1),
(2) Date: Feb. 24, 2020

(87) PCT Pub. No.: WO2019/100089

PCT Pub. Date: May 31, 2019

(65) Prior Publication Data

US 2021/0404121 A1 Dec. 30, 2021

(30) Foreign Application Priority Data

Nov. 21, 2017 (AT) ..... A 455/2017

(51) Int. Cl.

| | |
|---|---|
| ***E01B 7/22*** | (2006.01) |
| ***E01B 3/46*** | (2006.01) |
| ***E01B 9/68*** | (2006.01) |

(52) U.S. Cl.

CPC ..... *E01B 7/22* (2013.01); *E01B 3/46* (2013.01); *E01B 9/681* (2013.01); *E01B 2204/01* (2013.01)

(58) Field of Classification Search

CPC ... E01B 7/22; E01B 3/46; E01B 9/681; E01B 2204/01; E01B 9/68; E01B 9/683; E01B 9/685; E01B 9/688

See application file for complete search history.

(56) References Cited

U.S. PATENT DOCUMENTS 4,609,144 A * 9/1986 Harmsen ..... E01B 1/005 238/1
5,692,677 A * 12/1997 Duconseil ..... E01B 9/686 238/351

(Continued)

FOREIGN PATENT DOCUMENTS

| | | |
|---|---|---|
| AT | 503772 | 6/2008 |
| AT | 506529 | 5/2010 |

(Continued)

OTHER PUBLICATIONS

WO-2016077852, description section (English translation) (Year: 2016).*

(Continued)

*Primary Examiner* — Mark T Le
(74) *Attorney, Agent, or Firm* — Volpe Koenig

(57) ABSTRACT

A switch (1) for a track system for rail vehicles, wherein the switch (1) has rails (2) and a sequence of sleepers (4) and, in each case on an upper side (5) of the respective sleeper (4), at least two of the rails (2) are fixed to each other in pairs opposite each other, and in each case an intermediate layer (6) is arranged between each one of the rails (2) and the respective sleeper upper side (5), and the sleepers (4) each have a sleeper pad (8) on their undersides (7), opposite their respective upper sides (5), and the sleeper pads (8) each have at least one elastomer layer (9), wherein the intermediate layers (6) each have at least one elastomer layer (10).

15 Claims, 2 Drawing Sheets

(56) References Cited

U.S. PATENT DOCUMENTS

| | | | | |
|---|---|---|---|---|
| 2006/0289667 | A1* | 12/2006 | Nevins | E01B 9/681 238/382 |
| 2008/0083835 | A1 | 4/2008 | Girardi et al. | |
| 2008/0116291 | A1* | 5/2008 | Kawai | E01B 9/68 238/382 |
| 2010/0320281 | A1 | 12/2010 | Potocan et al. | |
| 2018/0127922 | A1 | 5/2018 | Augustin et al. | |

FOREIGN PATENT DOCUMENTS

| | | | | |
|---|---|---|---|---|
| CN | 2371218 | | 3/2000 | |
| CN | 101122109 | | 2/2008 | |
| DE | 19911467 | | 9/2000 | |
| DE | 202009001787 | | 5/2009 | |
| DE | 102015205484 | | 10/2015 | |
| EP | 0552788 | | 7/1993 | |
| EP | 1288370 | | 3/2003 | |
| EP | 1857590 | | 11/2007 | |
| EP | 1905896 | | 4/2008 | |
| FR | 2410086 | | 6/1979 | |
| RU | 2487207 | | 3/2009 | |
| RU | 2382844 | | 2/2010 | |
| WO | 2016077852 | | 5/2016 | |
| WO | WO-2016077852 | A1 * | 5/2016 | E01B 3/46 |

OTHER PUBLICATIONS

BWG—Voestalpine One Step Ahead, ERL Elastic Ribbed Plate Support, www.voestalpine.com/bwg, admitted prior art, Sep. 2008.

* cited by examiner 2
32
6
10
4
8,9
5
13
7

5
4
28
2
22
6,10
31
7
22
2
6,10
8,9

5
4
8,9
6,10
2,29
19
11
6,10
2,30
17
2,30
7
12
31
6,10
2,29
19
11
6,10

4
8,9
2,29
6,10
11
31
5
2,30
6,10
12

28
5
6,10
7
8,9
4
6,10
5
7
8,9
6,10
5
2
13
6,10
7
8,9

SWITCH

TECHNICAL FIELD

The present invention relates to a switch for a track system for rail vehicles, wherein the switch comprises rails and a sequence of sleepers and, in each case on an upper side of the respective sleeper, at least two of the rails are fixed to each other in pairs opposite one another, and between a respective one of the rails and the respective sleeper upper side an intermediate pad is arranged in each case and the sleepers, on their respective sleeper undersides situated opposite the sleeper upper sides each comprise a sleeper pad, and the sleeper pads each comprise at least one elastomer layer.

BACKGROUND

In track systems, switches constitute points of intersection in which at least one turnout track is guided into a main track or guided out of the same. There are so-called standard switches in the case of which a turnout track is guided out of a main track or guided into the same. However there are also so-called diamond crossings with slips, in which a turnout track crosses a main track and via the same leads out on both sides.

It is known in the prior art to equip tracks both in the region between switches and also in the region of the switches with elastomer layers in order to thereby achieve a smoothing of the rail subsidence and vibration damping when a train passes over. It is known for example to arrange so-called sleeper pads under the sleepers. These sleeper pads are thus situated between the sleeper and a ballast bed or a solid road on which the respective sleeper is supported. Sleeper pads are known for example from AT 506 529 B1 and WO 2016/077852 A1. In AT 506 529 B1 for example a sleeper pad is described, in the case of which on an elastic layer of the sleeper pad on the side facing the sleeper a randomly oriented fiber layer and on the opposite side a reinforcement layer and a further elastic layer are affixed. The randomly oriented fiber layer serves for fixing the sleeper pad on sleepers cast from concrete. The reinforcement layer on the other side of the sleeper pad limits the entering of the ballast of the ballast bed into the sleeper pad to the desired dimension.

However, elastic intermediate layers are also known in the prior art on the sleeper upper side, i.e. between rail and sleeper. This is described for example in EP 0 552 788 A1.

AT 503 772 B1 shows a generic switch in which, on the sleeper undersides of the sleepers, sleeper pads with at least one elastomer layer are arranged in each case. Between the rails and the sleepers intermediate layers are situated in AT 503 772 B1, which in this publication are referred to as fixing means. From AT 503 772 B1 it is known, furthermore, to vary the softness or hardness of the sleeper padding over the length of the sleeper.

Thus, different approaches are known in the prior art in order in particular with switches for track systems to ensure a rail subsidence smoothing when a train passes over, wherein in the prior art in each case a single elastic plane is employed in the overall structure and optionally optimized to achieve this objective.

SUMMARY

The object of the invention is improving a switch of the type mentioned above so that an improved rail subsidence smoothing upon crossing of a train can be achieved.

Starting out from the generic prior art, the invention provides a switch with one or more features of the invention for this purpose, in the case of which the intermediate layers each also comprise at least one elastomer layer.

In contrast with the prior art it is thus a basic idea of the invention to realize not only one but at least two elastic planes which, seen in the installation position, are spaced apart from one another in the vertical direction, in order to improve the rail subsidence smoothing when a train passes over the switch. Here, an elastic plane is formed through the at least one elastomer layer of the sleeper pads. A second elastic plane is formed through the elastomer layers of the intermediate layers. The elastic properties of these elastomer layers can be matched to one another depending on requirement in order to thus achieve an optimization matched to one another by both elastic planes. By way of this, the damping characteristics of the overall system of the switch can be very precisely adapted to the different requirements that occur in the switch in different locations. The subsidence can be homogenized over the course of the switch. Utilizing at least one second elastic plane allows a fine adjustment of the elastic properties of the switch to the respective tasks to be specifically solved within the switch in different places.

In switches according to the invention, both the sleeper pads and also the intermediate layers can each be constructed in single or multiple parts. Both the sleeper pads and also the intermediate layers can each consist of a single elastomer layer. However, they can also each comprise multiple elastomer layers. In addition to this, the sleeper pads as well as the intermediate layers can also comprise non-elastic components or layers. In the case of the sleeper pads, it can be a multi-layered construction known for example from AT 503 772 B1 having two elastic layers, a reinforcement layer and a randomly oriented fiber connecting layer. In addition to the at least one elastomer layer, the intermediate layers can also comprise metal plates as is also exemplarily explained in the figure description further back.

Preferred versions of the invention provide that in the switch the elastomer layers of at least two different sleeper pads have a bedding modulus that is different from one another and/or that in the switch the elastomer layers of at least two different intermediate layers have a stiffness that is different from one another. In terms of the difference it is favorably provided that the bedding moduli of the elastomer layers of the at least two different sleeper pads deviate from one another by an amount of at least 25% of the larger bedding modulus and/or that the stiffnesses of the elastomer layers of the at least two different intermediate layers deviate from one another by an amount of at least 25% of the greater stiffness.

In particular the sleeper pads can also have regions along the longitudinal direction of the sleeper that are different in softness or hardness. This can be a single continuous sleeper pad but also sections that are separated from one another, which together form the sleeper pad.

As already clear from this term, the elastomer layers are layers of at least one elastomer. Elastomers are dimensionally stable but elastically deformable plastics which elastically deform in the event of tensile and compressive loads but thereafter at least substantially return again to their original, undeformed shape. Particularly preferably it is provided that the elastomer layer of the respective intermediate layer and/or the elastomer layer of the respective sleeper pad comprises polyurethane or rubber or a mixture with polyurethane and/or rubber. The mentioned elastomer layers can also consist entirely of the mentioned materials. In the case of rubber, it can be natural but also synthetic rubber elastomers. Preferably, it is foamed polyurethane and/or foamed rubber. Both farmed versions are preferably of the closed-pore type.

Preferably it is provided that the elastomer layer of the respective sleeper pad has a bedding modulus in the range from 0.02 $N/mm^3$ (Newton per cubic millimeter) to 0.6 $N/mm^3$, preferentially of 0.1 $N/mm^3$ to 0.5 $N/mm^3$, particularly preferably of 0.15 $N/mm^3$ to 0.4 $N/mm^3$.

The bedding modulus is frequently used for describing the deformation behavior in the ballast track. It describes the ratio of surface pressure to associated subsidence. A softer material thus has a smaller bedding modulus and vice versa. Simplified, the bedding modulus indicates a defined subsidence materializing at a specific surface pressure.

In the case of the elastomer layer of the respective intermediate layer a stiffness in the range from 5 kN/mm (kilo Newton per millimeter) to 1,000 kN/mm, preferentially of 10 kN/mm to 300 kN/mm, particularly preferably of 20 kN/mm to 200 kN/mm is favorably provided. The stiffness could also be referred to as resilience number or support point stiffness. It describes the ratio of support point force to the subsidence. In the case of softer materials, the stiffness is lower than with materials that are harder relative to the former.

The bedding modulus can be determined for example according to DIN 45673, Edition of August 2010. The stiffness can be determined according to EN 13146, Edition of April 2012.

Using the basic principle of the at least two elastic planes in the switch according to the invention, which can be suitably matched to one another, different specific tasks can be better solved within the switch than is possible in the prior art. For example, using the basic principle according to the invention, a tilting of the sleepers can be better counteracted in specific locations in the switch; for example, this is possible in particular in the frog region or in the region of short sleepers within the switch. To this end, it is provided in particularly preferred configurations of the invention that the elastomer layer of the sleeper pad of a respective one of the sleepers comprises at least two regions of different softness, wherein the harder region of the elastomer layer of the sleeper pad is arranged under a first one of the rails and the softer region of the elastomer layer of the sleeper pad under a second one of the rails, wherein the first one of the rails and the second one of the rails are fixed, spaced apart from one another, to the sleeper upper side of the respective sleeper and the elastomer layer of the intermediate layer arranged between the first one of the rails and the sleeper upper side of this sleeper and the elastomer layer of the intermediate layer arranged between the second one of the rails and the sleeper upper side of this rail have a different softness relative to one another. Thus in addition to the principle known per se from the prior art of configuring the softness differently in the longitudinal direction along the sleeper it can be additionally provided that the elastomer layers of the intermediate layers above the sleeper, i.e. on the sleeper upper side are also configured with a different hardness or softness in the places that are spaced apart from one another in the longitudinal direction of the sleeper. Particularly preferably it is provided here that in the region above a relatively soft region of the elastomer layer of the sleeper pad an intermediate layer with a relatively soft elastomer layer is also situated and vice versa. In this sense it is also favorably provided that the elastomer layer of the intermediate layer arranged between the first one of the rails and the sleeper upper side of this sleeper is harder than the elastomer layer of the intermediate layer arranged between the second one of the rails and the sleeper upper side of this sleeper. Through this variation of the hardnesses or softnesses both in the intermediate layer and also in the sleeper pad along the longitudinal direction of the sleeper, an improved and more homogenous load transfer can be achieved in a particularly finely matched manner in order to thus counteract tilting of the sleepers. Particularly preferably, this version of the basic principle according to the invention is employed to the short sleepers following the last continuous sleeper but also in the so-called frog region of the switch.

Another application of the abovementioned basic principle of the invention in switches according to the invention can also be employed for avoiding sudden transitions in the elastic properties in the longitudinal direction of the switch i.e. both in the longitudinal direction of the main track and also of the turnout track. To this end it is provided in preferred versions that, seen in a longitudinal direction transversely, preferentially orthogonally, to the sleepers, the elastomer layers of the sleeper pads of at least two of the sleepers arranged in succession are formed with a different softness relative to one another and the elastomer layers of the intermediate layers on at least two of the sleepers arranged in succession are also formed with a different softness relative to one another, wherein in the case of a change of the softness of the elastomer layer of the sleeper pad from one of the sleepers to the sleeper following thereon in the longitudinal direction, the elastomer layers of the intermediate layers on these two sleepers have identical softness and/or in the case of a change of the softness of the elastomer layer of the intermediate layer from one of the sleepers to the sleeper following thereon in the longitudinal direction, the elastomer layers of the sleeper pads under these two sleepers have identical softness. In simple terms, it is thus provided with this application of the basic principle according to the invention that changes in the softness in the plane of the sleeper padding are not simultaneously accompanied by changes in the softness in the plane of the intermediate layers but these changes in the longitudinal direction transversely to the sleepers are offset relative to one another by at least one sleeper. By way of this, the changes in the elastic properties along the switch can be smoothed or dispersed. This principle is favorably applied throughout the switch region. An overlapping across multiple sleepers is favorable. According to this version of the basic principle according to the invention it is thus provided that changes in the softness or hardness in the plane of the intermediate layers are always arranged offset relative to changes in the softness or hardness in the plane of the sleeper padding.

Another application of the basic principle according to the invention can be utilized for improvements in the so-called switch area of the switch. In this so-called switch area of the switch it should be noted on the one hand that the ballast bed is generally relatively thin there, i.e. formed with a relatively short vertical extent and the sleepers are additionally relatively short. On the other hand, a force congestion also occurs in particular in this region of the rail through the temperature-related expansion and contraction of the rails but also through switch heaters often arranged there. Both together result in a tendency of the tracks to laterally bend out horizontally. In order to counteract this tendency, the sleeper padding in the switch area should be formed so as to be relatively plastic or ductile in order to achieve as high as possible a transverse displacement resistance in the ballast bed or on any other base. On the other hand, this again results in the elastic properties being relatively hard even in the vertical direction. In order to compensate for that, it can be provided that in particular in a switch area of the switch, the elastomer layer of the intermediate layer on a respective one of the sleepers is softer than the elastomer layer of the sleeper pad under this sleeper. Through the relatively soft elastomer layer in the intermediate layer an elastomer layer in the sleeper pad that is relatively hard so as to ensure the necessary transverse displacement resistance can thus be compensated for so that altogether the desired elastic behavior materializes in the vertical direction. In particular it is favorably provided that, in particular in a switch area of the switch, the elastomer layers of the sleeper pad are formed so as to be viscoplastic with an EPM index in a range from 10% to 25%, preferably from 10% to 20%, wherein the EPM index is as defined in WO 2016/077852 A1 and can be measured.

Furthermore it is favorable when, in particular in a switch area of the switch, the elastomer layers of the intermediate layers have a stiffness in a range from 20 kN/mm to 200 kN/mm, preferentially of 40 kN/mm to 100 kN/mm. The preferred relationships and properties as explained herein can each apply for the at least one elastomer layer of the sleeper pad and/or the at least one elastomer layer of the intermediate layer, but also for the entire sleeper pad and/or the entire intermediate layer.

BRIEF DESCRIPTION OF THE DRAWINGS

Further features and details of preferred versions of the invention are exemplarily explained in the following by way of the figure description.

DETAILED DESCRIPTION

Figure 1:
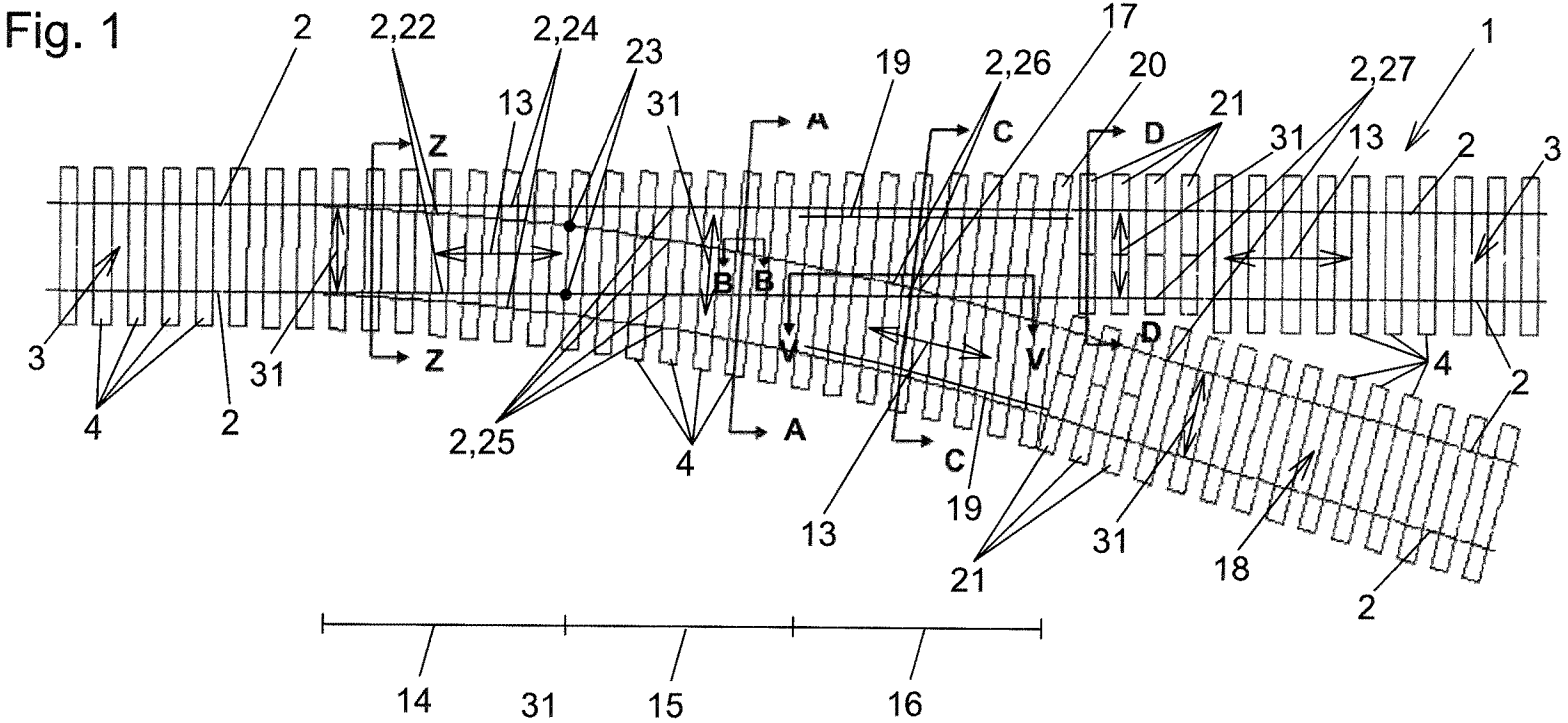
FIG. 1 shows a schematized representation of a switch according to the invention in the form of a so-called standard switch in a plan view.

The switch 1 shown schematized in a plan view in FIG. 1 is a so-called standard switch, in which a turnout track 18 leads into a main track 3. For the sake of completeness it is pointed out that the invention can also be realized with so-called diamond crossing with slips, in which a turnout track 18 on the one hand leads into the main track 3 and on the other hand leads over and out of the same. The track with the most traffic is referred to as the main track 3. The turnout track 18 is generally a track with less traffic.

In front of and behind the switch, the rails 2 are fixed in each case to one of the sleepers 4 in pairs situated opposite one another. The sleepers 4 are arranged along the entire switch transversely and in certain regions even orthogonally to the longitudinal direction 13 of both the main track 3 and also of the turnout track 18. The switch 1 itself comprises the switch area 14, the closure track area 15 and the frog area 16. In the switch region 14 are situated the switch rails 23 which are pivotably arranged on the switch rail joints 23. The frog 17 is situated in the frog area 16 of the switch 1. The closure track area 15 of the switch 1 is situated between the switch area 14 and the frog area 16. The respective closure rails 25 each fixed rigidly to the sleepers 4 are situated in the closure track area 15. In the switch area 14, the rails 2 situated outside are also referred to as stock rails 24. The frog area 16 of the switch 1 ends on the side facing away from the switch area 14 with the last continuous sleeper 20, which is frequently also referred to as LDS. This is followed both in the region of the main track 3 and also in the region of the turnout track 18 by multiple so-called short sleepers 21, which because of the given space conditions are formed shortened on one side relative to the sleepers 4 used in the main track 3 and in the turnout track 18 for the sake of space.

In the frog region 17, the rails 2 are frequently referred to as wing rails 26. The rails 2 in the region of the short sleepers 21 are frequently referred to as connecting rails 27. As is known per se and also drawn in here, so-called check rails 19 can also be present in the closure track area 15 and the frog area 16. The construction of the switch 1 from FIG. 1 narrated up to now is known per se and need therefore not be explained further. The term of the rail 2 basically comprises all types of rails 2 regardless of whether these are specifically referred to and additionally provided with a separate sign or not.

FIGS. 2 to 7 explained in the following are each vertical sections along the abovementioned section lines, shown in a schematized manner. Shown in each case is how in the relevant sections the respective rails 2 are supported on the sleeper upper sides 5 of the sleepers 4 by the intermediate layers 6 and the sleepers 4 are supported on a ballast bed 28 by way of the sleeper pads 8 arranged on their sleeper undersides 7. The type of the fixing of the rails 2 and of the intermediate layers 6 on the sleepers 4 is not shown in the representations. It can be embodied as in the prior art. The same applies to the fixing of the sleeper pads 8 to the sleeper undersides 7 of the sleepers 4.

Instead of the ballast bed 28, a solid substructure for example in the form of concrete slabs or the like known per se can also be present. The sleeper pads 8 can, in particular with a solid substructure, be not only arranged on the sleeper underside 7 but also on the lateral surfaces of the respective sleeper 4, preferentially project a little towards the top. In particular in this case, the sleeper pads 8 can also be referred to as sleeper shoes. These can also comprise sleeper shoe insert plates known per se.

Figures 4, 5, 6, 7, 8:
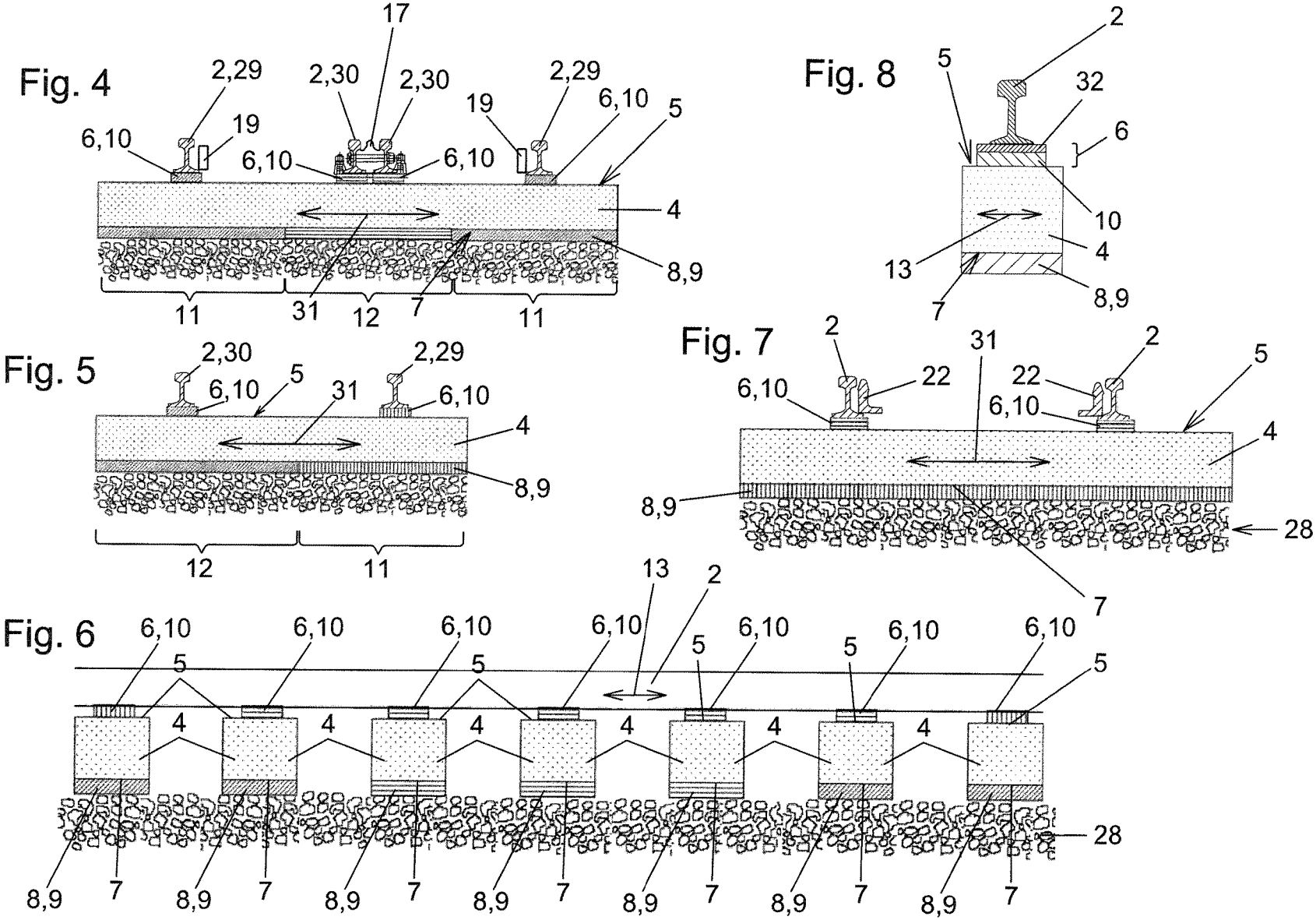
FIG. 4 shows a schematized vertical section along the section line CC from FIG. 1.
FIG. 5 shows a schematized representation of a vertical section along the section line DD from FIG. 1.
FIG. 6 shows a schematized vertical section along the section line VV from FIG. 1.
FIG. 7 shows a schematized vertical section along the section line ZZ from FIG. 1.
FIG. 8 shows, schematized, an alternative configuration of an intermediate layer.

Apart from FIG. 8, both the intermediate layers 6 and also the sleeper pads 8 are shown designed as single-layer bodies in the form of elastomer layers 10 and 9 respectively. As explained at the outset, this need not be so. Both the intermediate layers 6 and also the sleeper pads 8 can comprise further layers in addition to their elastomer layers 10 and 9 respectively, as was already explained at the outset and will still be exemplarily described at least for the intermediate layer 6 by way of the FIG. 8 further down below.

In all figures described in the following, the elastomer layers 9 of the sleeper pads 8 and also the elastomer layers 10 of the intermediate layers 6 are hatched differently. Each type of the hatch stands exemplarily for a certain hardness or softness of the respective elastomer layer 9 and 10 respectively, wherein the selected representation is purely about the relationships relative to one another. In all representations, the hardest of the elastomer layers 9 and 10 respectively are vertically shaded. Medium degrees of hardness or softness are shaded obliquely. The elastomer layers 9 and 10 that are softest relative thereto are marked by a horizontal hatching.

Figure 2:
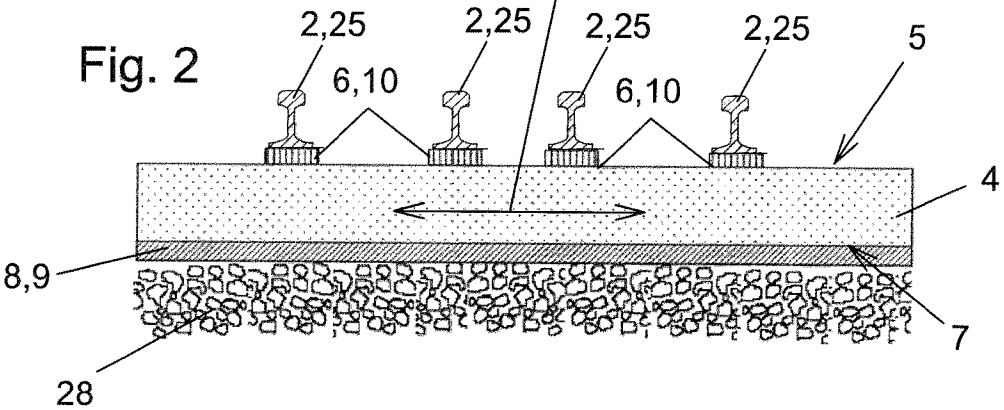
FIG. 2 shows a schematized vertical section along the section AA from FIG. 1.

FIG. 2 shows the vertical section along the section line AA in the closure track area 15, in which the rails 2 are also referred to as closure rails 25. As explained at the outset, two elastic planes that are vertically spaced apart from one another are present. The lower elastic plane is formed through the elastomer layer 9 of the sleeper pad 8. The upper elastic plane is realized through the elastomer layers 10 of the intermediate layers 6. By matching the elastic properties or the softness of the respective elastomer layers 9 and 10 employed, the overall elasticity along the switch 1 can, generally speaking, be adapted to the respective requirements present. In the closure track area 15 according to FIG. 2, the elasticity or softness of the elastomer layer 9 of the sleeper pad 8 over the entire longitudinal extent in the longitudinal direction 31 of the sleeper 4 is designed constant. The elastomer layers 10 of the intermediate layers 6 arranged on the sleeper upper side 5 are harder than the elastomer layer 9 of the sleeper pad 8, but formed with equal softness or hardness relative to one another.

Figure 3:
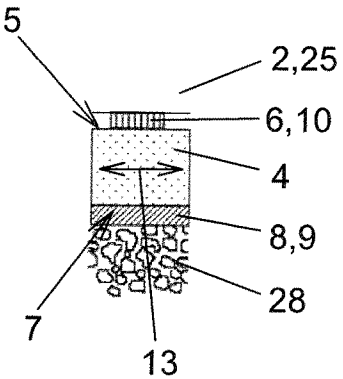
FIG. 3 shows a schematic vertical section along the section line BB from FIG. 1.

FIG. 3 shows a vertical section along the section line BB from FIG. 1 in the longitudinal direction 13 of the switch 1 through the same sleeper as FIG. 2.

FIG. 4 shows the vertical section in the frog area 16 of the switch 1 along the section line CC from FIG. 1 and thus along a sleeper 4 formed as long sleeper, which when a train passes over is always eccentrically loaded, since the train travels either along the main track 3 or along the turnout track 18. Of necessity, this results in a one-sided loading and thus a tendency towards tilting of the sleepers 4 in this region. In order to counteract this, the regions 11 of the elastomer layer 9 of the sleeper pad 8 situated outside are formed harder than the middle region 12 of the elastomer layer 9 of the sleeper pad 8. This possibility for compensating for tilting effect however has limits. In order to avoid overloading these sleepers 4 in their middle portion, the softness in the sleeper pad 8 or its elastomer layer 9 in the region 12 must not deviate too much from the marginal regions 11. In order to nevertheless achieve an ideal softness of the support of the second rails 30 in this middle region of the sleeper 4, the softness of the elastomer layers 10 of the intermediate layers 6 is additionally varied along the longitudinal direction 31 of the sleeper 4. This is thus a first example in which it is provided that the elastomer layer 9 of the sleeper pad 8 of a respective one of the sleepers 4 comprises at least two regions 11 and 12 with a different softness, wherein the harder region 11 of the elastomer layer 9 of the sleeper pad 8 is arranged under a first one of the rails 29 and the softer region 12 of the elastomer layer 9 of the sleeper pad 8 under a second one of the rails 30, wherein the first one of the rails 29 and the second one of the rails 30, are fixed, spaced apart from one another, to the sleeper upper side 5 of the respective sleeper 4 and the elastomer layer 10 of the intermediate layer 6 arranged between the first one of the rails 29 and the sleeper upper side 5 of this sleeper 4 and the elastomer layer 10 of the intermediate layer 6 arranged between the second one of the rails 30 and the sleeper upper side 5 of this sleeper 4 have a different hardness relative to one another, wherein here it is concretely provided that the elastomer layer 10 of the intermediate layer 6 arranged between the first one of the rails 29 and the sleeper upper side 5 of this sleeper 4 is harder than the elastomer layer 10 of the intermediate layer 6 arranged between the second one of the rails 30 and the sleeper upper side 5 of this sleeper 4.

A second example in which the softness of the elastomer layers 9 and 10 is varied both in the sleeper pad 8 and also in the intermediate layers 6 along the longitudinal direction 31 of the sleeper 4 is shown in FIG. 5. This is a vertical section along the section line DD from FIG. 1, i.e. a vertical section of the short sleeper 21 directly following the last continuous sleeper 20. These short sleepers 21 have a tendency towards tilting since because of the space requirement restricted on one side they protrude less far over the rail 2 on a side than on the opposite side. This tilting effect can be likewise counteracted with regions 11 and 12 of the elastomer layer 9 of the sleeper pad 8 of different softness or hardness. Measurements however have shown that by way of this a smoothing can be achieved but the introduced loads are still highly inhomogeneous, so that different instances of subsidence can occur in the substructure, i.e. in the ballast bed 28 because of this. Here, too, a further fine matching of the elasticities or softness in the longitudinal direction 31 along the sleeper 4 can be achieved through the additionally present elastomer layers 10 of the intermediate layers 6, i.e. through a second elastic plane, which altogether results in an improved and more homogenous load removal also in the region of these short sleepers 21 shortened on one side. Here it is also preferably provided that a softer intermediate layer 6 is situated above a softer region 12 of the sleeper pad 8 and also a harder intermediate layer 6 above the harder region 11 of the sleeper pad 8.

FIG. 6 shows a longitudinal section parallel to the longitudinal direction 13 of the switch 1 or of the main track 3 transversely to the sleepers 4. The principle that changes in the elasticity in the elastomer layers 9 and 10 of the sleeper pad 8 and the intermediate layer 6 are only realized exclusively offset relative to one another, i.e. not between the same sleepers 4 is realized here. It is thus provided in FIG. 6 that, seen in a longitudinal direction 13 transversely, preferentially orthogonally, to the sleepers 4, the elastomer layers 9 of the sleeper pads 8 of at least two of the sleepers 4 arranged in succession are formed relative to one another with a different softness and also the elastomer layers 10 of the intermediate layers 6 on at least two sleepers 4 arranged in succession likewise with a different softness relative to one another, wherein in the case of a change in the softness of the elastomer layer 9 of the sleeper pad 8 from one of the sleepers 4 to the sleeper 4 following thereon in the longitudinal direction 13, the elastomer layers 10 of the intermediate layers 6 on these two sleepers 4 have the same softness and/or in the case of a change in the softness of the elastomer layer 10 of the intermediate layer 6 from one of the sleepers 4 to the sleeper 4 following thereon in the longitudinal direction, the elastomer layers 9 of the sleeper pads 8 under these two sleepers 4 are identical in softness. Because of the fact that the changes in the elasticity or softness at transitions in the two elastic planes occur offset relative to one another in the longitudinal direction 13, sudden changes in the elastic properties along the switch 1 are avoided. There is thus a kind of dispersing or equalizing effect. This is exemplarily shown in FIG. 6. Seen from the left to the right, the elasticity of the elastomer layer 10 of the intermediate layer 6 initially changes between the first and the second sleeper 4 while the elasticity of the elastomer layer 9 of the sleeper pad 8 at the transition from the first to the second sleeper 4 remains the same. From the second to the third sleeper 4 the elasticity or softness of the elastomer layer 9 is then changed in the sleeper pad 8 while at the transition between these two sleepers the elasticity or softness of the elastomer layer 10 of the intermediate layer 6 remains unchanged. Then, between the third and fourth as well as between the fourth and fifth sleeper 4 neither the elasticity of the elastomer layer 9 nor that of the elastomer layer 10 changes, while between the fifth and sixth sleeper 4 the softness of the elastomer layer 9 of the sleeper pad 8 then changes, while the softness of the elastomer layer 10 of the intermediate layer 6 remains the same. At the transition from the sixth to the seventh sleeper 4, the softness of the elastomer layer 10 of the intermediate layer 6 is then changed while in the softness of the elastomer layer 9 of the sleeper pad 8 between these two sleepers 4 no change materializes any longer. This principle is favorably realized over the entire longitudinal extent of the switch 1, i.e. both in the main track 3 and also in the turnout track 18.

With the principles narrated so far by way of FIGS. 4 to 6 it is favorable in principle that with a bedding modulus of the elastomer layer 9 of the sleeper pad 8 in the region of 0.02 to 0.2 N/mm$^3$ the stiffness of the elastomer layer 10 of the intermediate layer 6 is in the range between 5 and 150 kN/mm. When the bedding modulus of the elastomer layer 9 of the sleeper pad 8 is in the range from 0.2 to 0.3 N/mm$^3$, the elastomer layer 10 of the intermediate layer 6 with such versions then favorably has a stiffness in the range from 10 to 200 kN/mm. When by contrast the bedding modulus of the elastomer layer 9 of the sleeper pad 8 is in a range from 0.3 to 0.6 N/mm$^3$, the elastomer layer 10 of the intermediate layer 6 with the mentioned versions then favorably has a stiffness in the range from 15 to 250 kN/mm.

FIG. 7 shows the section ZZ from FIG. 1 in the switch area 14. To ensure a correspondingly high transverse displacement resistance between the respective sleepers 4 and the substructure, here in the form of the ballast bed 28, sleeper pads 8 whose elastomer layers 10 have ductile properties are favorably employed here. The EPM index of the elastomer layers 9 of the sleeper pads 8 in this region is favorably in the range between 10% and 25%, preferably between 10% and 20%. The bedding modulus of the elastomer layers 9 of the sleeper pads 8 in this switch area 14 is favorably in the range from 0.1 to 0.6 N/mm$^3$. In order to nevertheless achieve an adequately soft mounting of the rails 2 in the vertical direction, the intermediate layers 6 in this switch area 14 are favorably formed suitably soft. Here, the elastomer layers 10 of the intermediate layers 6 favorably have a stiffness in the range from 20 to 200 kN/mm, preferably of 40 to 100 kN/mm. Altogether, it is thus favorably provided in the switch area 14 of the switch 1 that the elastomer layer 10 of the intermediate layer 6 on a respective one of the sleepers 4 is softer than the elastomer layer 9 of the sleeper pad 8 under this sleeper 4.

In the sections shown up to now, the intermediate layer 6 in each case consists of a single elastomer layer 10. As already explained at the outset, the intermediate layer 6 can also be constructed in multiple layers and of different materials however. Such an example is shown in FIG. 8. Here, the intermediate layer 6 has a metal plate 32 in addition to the elastomer layer 6. The rail 2 is fixed to the metal plate 32. Such metal plates 32 can be employed for example in order to enlarge the surface area with which pressure is exerted on the elastomer layer 10 of the intermediate layer 6. Naturally, there are numerous versions as to how the intermediate layer 6 can be constructed in multiple layers. This applies also to the sleeper pad 8, wherein in this case reference is made in particular to the prior art already mentioned at the outset, which shows multi-layer sleeper pads 8.

LEGEND FOR THE REFERENCE NUMBERS

1 Switch
2 Rail
3 Main track
4 Sleeper
5 Sleeper upper side
6 Intermediate layer
7 Sleeper underside
8 Sleeper pad
9 Elastomer layer
10 Elastomer layer
11 Region
12 Region
13 Longitudinal direction
14 Switch area
15 Closure track area
16 Frog area
17 Frog
18 Turnout track
19 Check rail
20 LDS
21 Short sleeper
22 Switch rails
23 Switch rail joint
24 Stock rails
25 Closure rails
26 Wing rails
27 Connecting rails
28 Ballast bed
29 First rail
30 Second rail
31 Longitudinal direction
32 Metal plate

The invention claimed is:

1. A switch for a track system for rail vehicles, the switch comprises:

rails;

a sequence of sleepers, each having a sleeper upper side and a sleeper underside, and in each case on the sleeper upper side of the respective sleeper at least two of the rails are fixed situated opposite one another in pairs;

a respective intermediate layer between each respective one of the rails and the respective sleeper upper side;

a respective sleeper pad arranged in each case on the respective sleeper undersides situated opposite the respective sleeper upper sides, the sleeper pads each have at least one elastomer layer;

the intermediate layers each have at least one elastomer layer; and wherein the elastomer layer of the sleeper pad of a respective one of the sleepers has at least two regions of different softness, wherein a harder of the at least two regions of the elastomer layer of the sleeper pad is arranged under a first one of the rails and a softer of the at least two regions of the elastomer layer of the sleeper pad is arranged under a second one of the rails, and the first one of the rails and the second one of the rails are fixed, spaced apart from one another, to the sleeper upper side of the respective sleeper and the elastomer layer of the intermediate layer arranged between the first one of the rails and the sleeper upper side of this sleeper and the elastomer layer of the intermediate layer arranged between the second one of the rails and the sleeper upper side of this sleeper have a different softness relative to one another.

2. The switch as claimed in claim 1, wherein in the switch, at least one of the elastomer layers of at least two different ones of the sleeper pads have a ballast modulus that is different from one another, or the elastomer layers of at least two different intermediate layers have a stiffness that is different from the another.

3. The switch as claimed in claim 1, wherein at least one of the elastomer layer of the respective sleeper pad has a bedding modulus in the range from 0.02 N/mm3 to 0.6 N/mm3, or the elastomer layer of the respective intermediate layer has a stiffness in the range from 5 kN/mm to 1,000 kN/mm.

4. The switch as claimed in claim 1, wherein at least one of the elastomer layer of the respective intermediate layer or the elastomer layer of the respective sleeper pad comprise foamed polyurethane or rubber or a mixture with foamed polyurethane and rubber.

5. The switch as claimed in claim 1, wherein the elastomer layer of the intermediate layer arranged between the first one of the rails and the sleeper upper side of this sleeper is harder than the elastomer layer of the intermediate layer arranged between the second one of the rails and the sleeper upper side of this sleeper.

6. The switch as claimed in claim 1, wherein in a switch area of the switch, the elastomer layer of the intermediate layer on a respective one of the sleepers is softer than the elastomer layer of the sleeper pad under this sleeper.

7. The switch as claimed in claim 1, wherein at least in a switch area of the switch, the elastomer layers of the sleeper pad are formed viscoplastic with an EPM index in a range from 10% to 25%.

8. The switch as claimed in claim 1, wherein at least in a switch area of the switch, the elastomer layers of the intermediate layers have a stiffness in a range from 20 kN/mm to 200 kN/mm.

9. A switch for a track system for rail vehicles, the switch comprises:

rails;

a sequence of sleepers, each having a sleeper upper side and a sleeper underside, and in each case on the sleeper upper side of the respective sleeper at least two of the rails are fixed situated opposite one another in pairs;

a respective intermediate layer between each respective one of the rails and the respective sleeper upper side;

a respective sleeper pad arranged in each case on the respective sleeper undersides situated opposite the respective sleeper upper sides, the sleeper pads each have at least one elastomer layer;

the intermediate layers each have at least one elastomer layer; and wherein, seen in a longitudinal direction transversely to the sleepers, the elastomer layers of the sleeper pads of at least two of the sleepers arranged in succession have a different softness relative to one another and the elastomer layers of the intermediate layers on at least two of the sleepers arranged in succession are also formed with a different softness relative to one another, and at least one of in the case of a change of the softness of the elastomer layer of the sleeper pad from one of the sleepers to the sleeper following thereon in the longitudinal direction, the elastomer layers of the intermediate layers on these two sleepers are equal in softness or in the case of a change of the softness of the elastomer layer of the intermediate layer from one of the sleepers to the sleeper following thereon in the longitudinal direction, the elastomer layers of the sleeper pads under these two sleepers are equal in softness.

10. The switch as claimed in claim 9, wherein in the switch, at least one of the elastomer layers of at least two different ones of the sleeper pads have a ballast modulus that is different from one another, or the elastomer layers of at least two different intermediate layers have a stiffness that is different from the another.

11. The switch as claimed in claim 9, wherein at least one of the elastomer layer of the respective sleeper pad has a bedding modulus in the range from 0.02 N/mm3 to 0.6 N/mm3, or the elastomer layer of the respective intermediate layer has a stiffness in the range from 5 kN/mm to 1,000 kN/mm.

12. The switch as claimed in claim 9, wherein at least one of the elastomer layer of the respective intermediate layer or the elastomer layer of the respective sleeper pad comprise foamed polyurethane or rubber or a mixture with foamed polyurethane and rubber.

13. The switch as claimed in claim 9, wherein in a switch area of the switch, the elastomer layer of the intermediate layer on a respective one of the sleepers is softer than the elastomer layer of the sleeper pad under this sleeper.

14. The switch as claimed in claim 9, wherein at least in a switch area of the switch, the elastomer layers of the sleeper pad are formed viscoplastic with an EPM index in a range from 10% to 25%.

15. The switch as claimed in claim 9, wherein at least in a switch area of the switch, the elastomer layers of the intermediate layers have a stiffness in a range from 20 kN/mm to 200 kN/mm.

* * * * *